US010814520B2

(12) United States Patent
Johnson et al.

(10) Patent No.: US 10,814,520 B2
(45) Date of Patent: Oct. 27, 2020

(54) PRESSURE ROLLER SYSTEM AND APPARATUS FOR ELIMINATING PLANER SNIPE AND CONFIGURED FOR QUICK CHANGE

(71) Applicant: WOODMASTER TOOLS, INC., Kansas City, MO (US)

(72) Inventors: George Willoughby Johnson, Kansas City, MO (US); Barry G. Bland, Gladstone, MO (US)

(73) Assignee: WOODMASTER TOOLS, INC., Kansas City, MO (US)

( * ) Notice: Subject to any disclaimer, the term of this patent is extended or adjusted under 35 U.S.C. 154(b) by 351 days.

(21) Appl. No.: 15/875,066

(22) Filed: Jan. 19, 2018

(65) Prior Publication Data

US 2018/0215066 A1 Aug. 2, 2018

Related U.S. Application Data

(60) Provisional application No. 62/453,303, filed on Feb. 1, 2017.

(51) Int. Cl.

| | |
|---|---|
| ***B27C 1/14*** | (2006.01) |
| ***B27C 1/04*** | (2006.01) |
| ***B27C 1/08*** | (2006.01) |
| ***B27G 21/00*** | (2006.01) |
| ***B27C 1/12*** | (2006.01) |

(52) U.S. Cl.

CPC ..... *B27C 1/14* (2013.01); *B27C 1/04* (2013.01); *B27C 1/08* (2013.01); *B27C 1/12* (2013.01); *B27G 21/00* (2013.01)

(58) Field of Classification Search

CPC .... B27C 1/00; B27C 1/02; B27C 1/04; B27C 1/08; B27C 1/12; B27C 1/14; B27C 5/06; B27C 1/06; B27B 25/00; B27B 25/02; B27B 25/06

USPC ..... 144/246.1, 247, 250.12, 250.13, 250.16

See application file for complete search history.

(56) References Cited

U.S. PATENT DOCUMENTS

| | | | | |
|---|---|---|---|---|
| 5,396,938 A * | 3/1995 | Cannaday | B27B 1/00 | 144/116 |
| 2012/0145281 A1* | 6/2012 | Crowder | B27C 5/06 | 144/2.1 |
| 2016/0121520 A1* | 5/2016 | Gramlich | B27C 5/06 | 264/40.1 |

* cited by examiner

*Primary Examiner* — Matthew Katcoff

(74) *Attorney, Agent, or Firm* — Lathrop GPM, LLP

(57) ABSTRACT

Disclosed herein is a system for substantially reducing, or eliminating, planer snipe on workpieces passing through the work area of a woodworking machine and providing a quick change out and adjustment of a press roller mounted to the hood of the woodworking machine.

6 Claims, 4 Drawing Sheets

PRESSURE ROLLER SYSTEM AND APPARATUS FOR ELIMINATING PLANER SNIPE AND CONFIGURED FOR QUICK CHANGE

RELATED APPLICATIONS

This application claims the benefit of priority to U.S. Provisional Application No. 62/453,303 filed on Feb. 1, 2017.

TECHNICAL FIELD

This disclosure relates to a quick change press roller for eliminating planer snipe on a workpiece transiting through the work area of woodworking machines such as planers and molders.

BACKGROUND

A planer is a woodworking machine for trimming boards to a consistent thickness along their entire length. A planer consists of three elements: a cutter head containing the cutting knives; a set of rollers which draw the board through the machine; and a table which is adjustable relative to the cutter head to control the resultant thickness of the board. Some portable thickness planers differ slightly in that the table is fixed and the cutter head/feed roller assembly is adjusted.

In operation, the table is set to the desired height and the workpiece is fed into the machine until it makes contact with the in-feed roller which grips the board and draws it into the machine and past the rotating cutter head. The knives remove material on the way through and the out-feed roller pulls the workpiece through and ejects it from the machine at the end of the pass.

To finish a board that is flat and of uniform thickness along its length, it is necessary to start with a board that has at least one perfectly flat reference face. The board is fed with this reference face flat on the table and the cutter head removes an amount of material from the opposite face so that it is made parallel to the reference face. The reference face is often created by first passing the board over a jointer. If the lower face is not flat, the feed roller pressure pressing the board against the table will deform the board, which will then spring back as it leaves the machine, resulting in a non-flat upper surface.

A wood molder is a machine used to shape wood with profiled cutters. Wood molders almost always have the capacity to serve as a wood planer as well. A molder planes off opposite faces and opposite side edges of a board traveling therethrough. With a four-sided molder a workpiece travels endwise through the molder which includes power-rotated molder knives functioning to plane off material from the board. Travel through the molder is produced by suitable means such, as a conveyor or feed rollers. A four sided molder shapes the wood with profiled cutters also known as knives, and blades. Most molders require the blades to be secured into a cutterhead that mounts on the shaft(s) of the machine.

One problem often encountered when using a planer or molder is snipe. This manifests as a deeper cut on a short section of the board at either end and is caused by incorrect feeding or misalignment of the in-feed or out-feed tables, or an unnecessarily high setting of the rollers recessed in the surface of the in-feed table. Snipe is usually quite subtle but creates a slight step that can typically be felt and seen by shining a light on the board at a shallow angle.

The most commonly employed solution to snipe is to utilize a board that is overlong to allow for later trimming. This solution; however, results in loss of potentially usable product, and increased costs associated with the disposal of the trimmed board lengths.

SUMMARY

The technology disclosed herein is for a press roller secured to the hood of a woodworking machine for the purpose of eliminating, or at least reducing, the formation of planer snipe. Disclosed herein is a system for addressing the formation of planer snipe on a workpiece passing through the work area of a woodworking machine. The disclosed system comprises a woodworking machine with a work area, the work area further comprising a plurality of feed rollers and at least one lower cutter head and at least one upper cutter head wherein the lower cutter head is configured to plane the lower surface of the workpiece and the upper cutter head is configured to plane the upper surface of the workpiece. In addition, at least one infeed roller and at least one outfeed roller are separated from one another and offset from the lower cutter head creating a gap between the infeed and outfeed rollers.

The disclosed system employs a hood for enclosing the work area. The hood is secured to one side of the four-sided woodworking machine and the hood is rotatably operable between a fully open and a fully closed position. The press roller is biased away from and mounted to the hood by brackets. When the hood is in the fully closed position the press roller is aligned with and positioned directly over the lower cutter head and between the infeed roller and outfeed rollers. When the workpiece transits past the infeed roller the press roller maintains a force applied to the workpiece preventing upward movement of a trailing portion of the workpiece and the formation of planer snipe on the workpiece.

The disclosed pressure roller system is further capable of a quick change-out to a larger or smaller pressure roller should there be a need to apply greater or lesser pressure to the workpiece beyond what the spring biased pressure roller in current use is capable of accommodating. With the disclosed system, an operator can quickly release the ends of the pressure roller from the first and second mounting brackets, remove the pressure roller and replace with a pressure roller of greater or lesser diameter or with an equivalent pressure roller for purposes of preventative maintenance.

Various objects, features, aspects and advantages of the disclosed subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

The contents of this summary section are provided only as a simplified introduction to the disclosure, and are not intended to be used to limit the scope of the appended claims.

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

Woodworking machines such as molders and planers are used to shape wood with profiled cutters. The profiled cutters are also known as knives, and blades. Tooling refers to cutters, knives, blades including planer blades, and cutterheads. Most woodworking machines require the blades to be secured into a cutterhead that mounts on the shaft(s) of the machine. The wood being fed into a woodworking machine is commonly referred to as either "stock" or "blanks" and is referenced as a workpiece in this disclosure.

Figure 1:
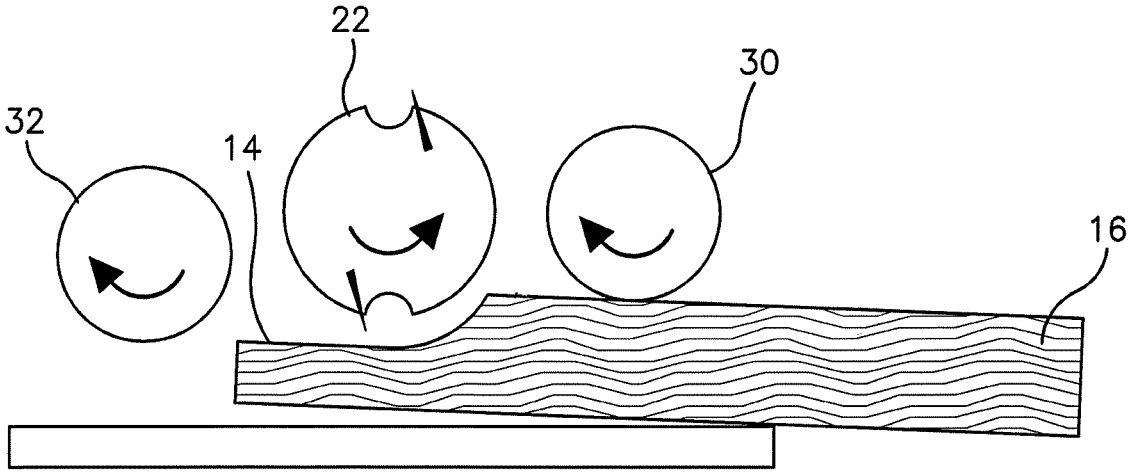
FIG. 1 depicts a workpiece experiencing planer snipe as the workpiece enters the woodworking machine.
Figure 2:
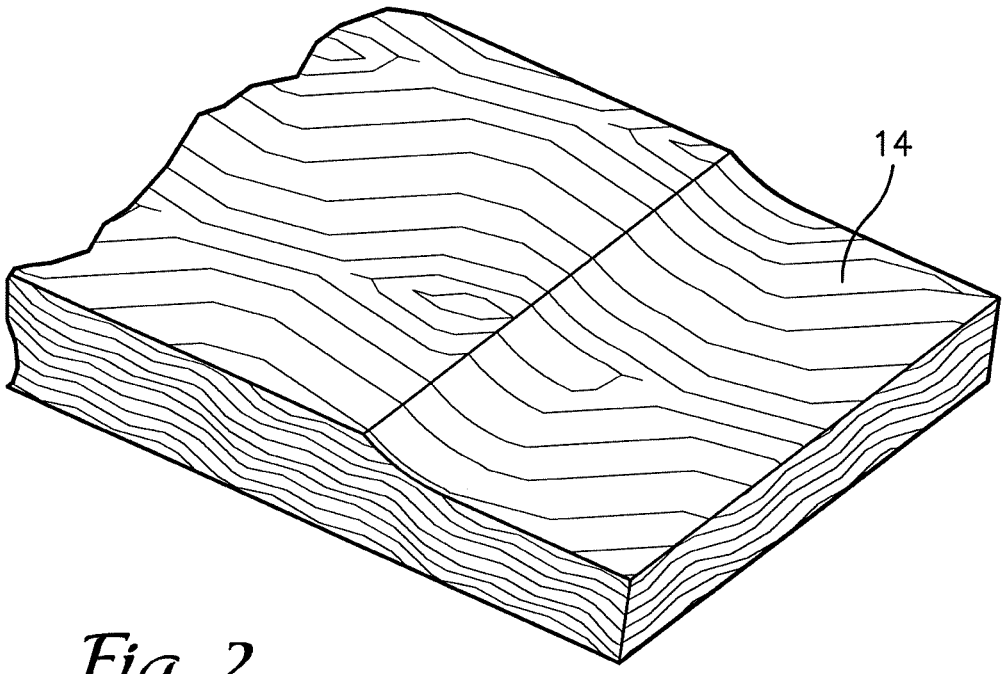
FIG. 2 depicts an exemplary planer snipe on a workpiece.

A woodworking machine such as a molder or a planer has one or more horizontal cutter heads, and may also have side cutter heads. As shown in FIG. 1 woodworking machines typically utilize two pressure rollers 30, 32, on either side of the cutter/drum head 22. The rollers 30, 32 hold the workpiece 16 down so that it registers consistently as it passes through the work area. As shown in FIG. 1, at the beginning and also at the very end of the pass, the workpiece 16 is only being held down by one roller 30. Snipe 14 occurs when the workpiece 16 lifts slightly, due to the fact that it is only being held down by this single roller 30. The end result, as shown in FIG. 2, is a workpiece that is slightly thinner at the leading and trailing ends, typically 3-4 inches in length.

Figure 3:
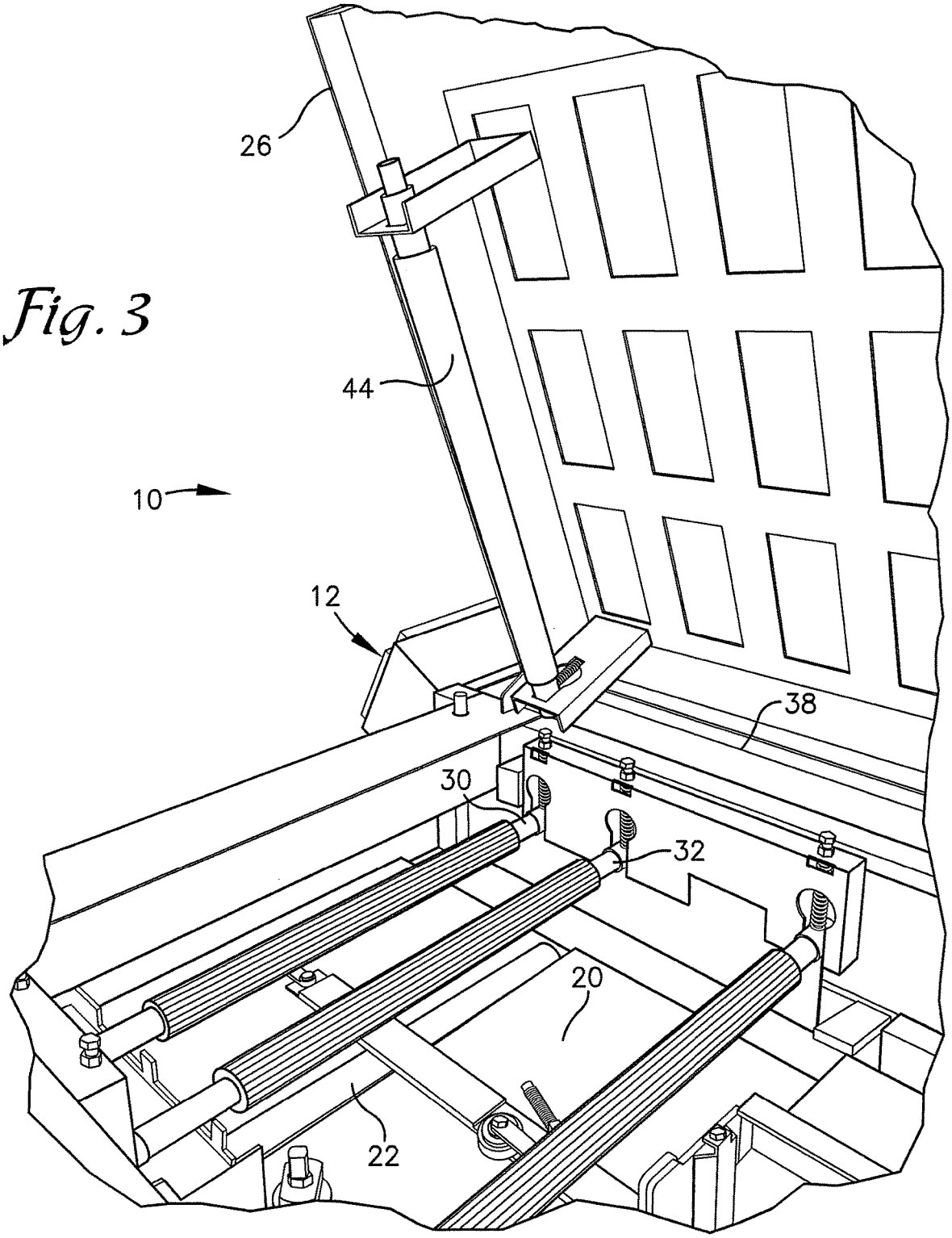
FIG. 3 depicts a perspective view of a woodworking machine with an embodiment of the press roller secured to the hood.
Figure 4:
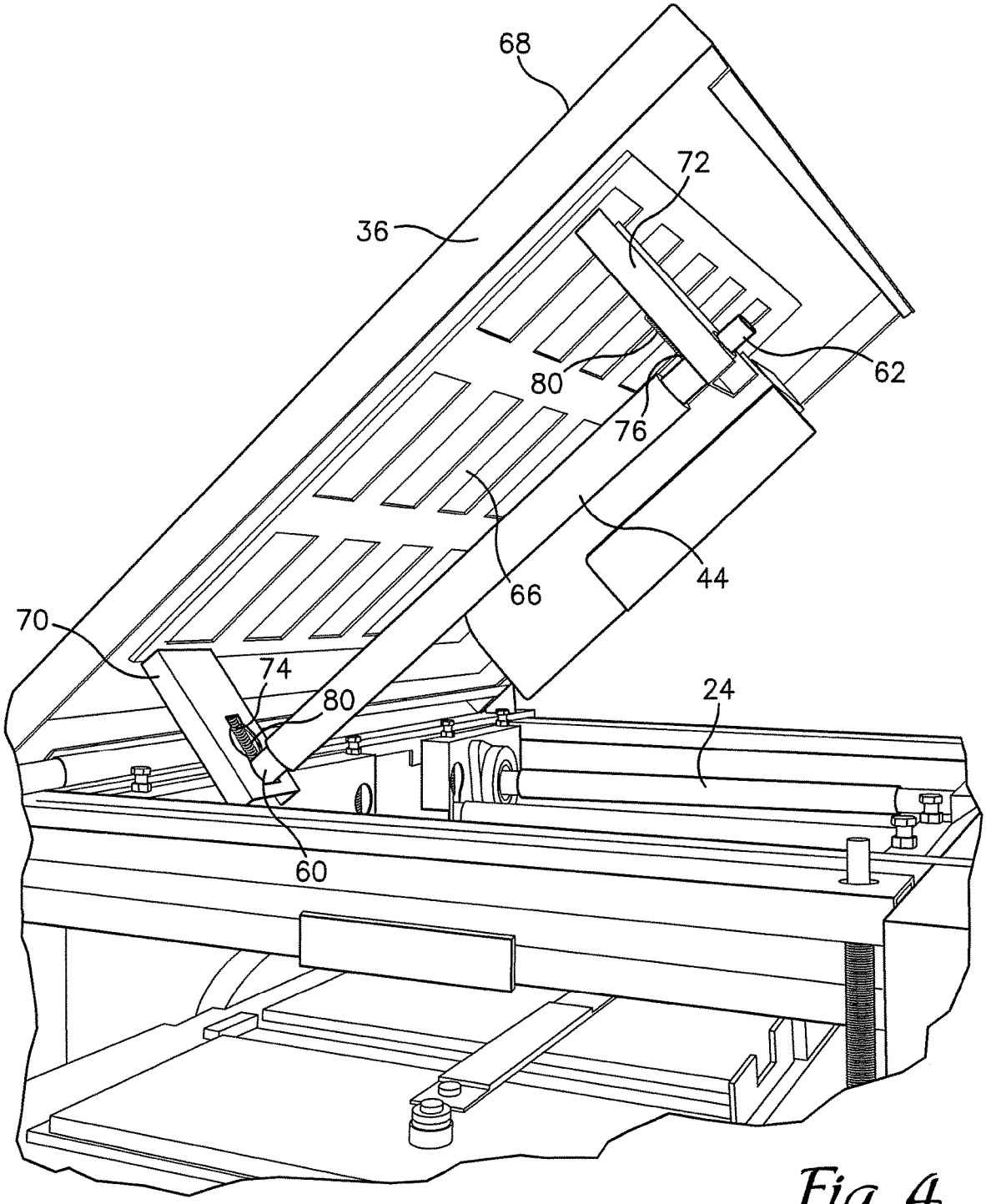
FIG. 4 depicts a side view of the woodworking machine with an embodiment of the press roller secured to the hood.

As shown in FIG. 3, an exemplary system 10 includes a woodworking machine 12 for reducing planer snipe on workpieces passing through the system 10. The woodworking machine 12 includes a work area 20, the work area further includes a plurality of feed rollers 30, 32 and at least one lower cutter head 22, as shown in FIG. 3, and at least one upper cutter head 24, as shown in FIG. 4. The lower cutter head 22 is configured to plane the lower surface of the workpiece and the upper cutter head 24 is configured to plane the upper surface of the workpiece. As shown in FIG. 3, one infeed roller 30 and one outfeed roller 32 are positioned above and opposite one another from the lower cutter head 22.

FIG. 3 further reveals a hood 36 for enclosing the work area 20. The hood 36 is rotatably secured at hinges 38 to one side of the woodworking machine 12. The hood 36 is operable between a fully open (as shown in FIG. 3) and a fully closed position wherein at least one press roller 44 is biased away from and mounted to the hood 36. The press roller 44 is preferably coated with a rubberized compound to reduce slippage of the workpiece. When the hood 36 is in the fully closed position the press roller 44 is disposed directly over and longitudinally aligned with the lower cutter head 22. The press roller 44 is also positioned between the infeed roller 30 and the outfeed roller 32.

When the hood 36 is in the fully closed position, the infeed roller 30, press roller 44 and outfeed roller 32 are all closely aligned, from an elevation perspective, and remain in contact with the workpiece as it passes through the work area 20. When the workpiece transits past the infeed roller 30 the biased press roller 44 maintains a downward force applied to the workpiece 16 preventing upward movement of a trailing portion of the workpiece and preventing the formation of planer snipe 14.

FIG. 4 reveals that the press roller 44 has a first end 60 and a second end 62. The hood 36 has an interior surface 66 and an exterior surface 68 with first and second brackets 70, 72 secured to the interior surface 66 of the hood 36. The first and second brackets 70, 72 include openings 74, 76. The first end 60 of the press roller 44 is inserted into the opening 74 in the first bracket 70 while the second end 62 of the press roller 44 is inserted into the opening 76 in the second bracket 72. Compression spring 80 is used to bias the position of the first end 60 of the press roller 44 within the opening in the first bracket 70 and similarly a second spring 82 biases the position of the second end 62 of the press roller 44 within the opening 76 in the second bracket 72.

Figure 5:
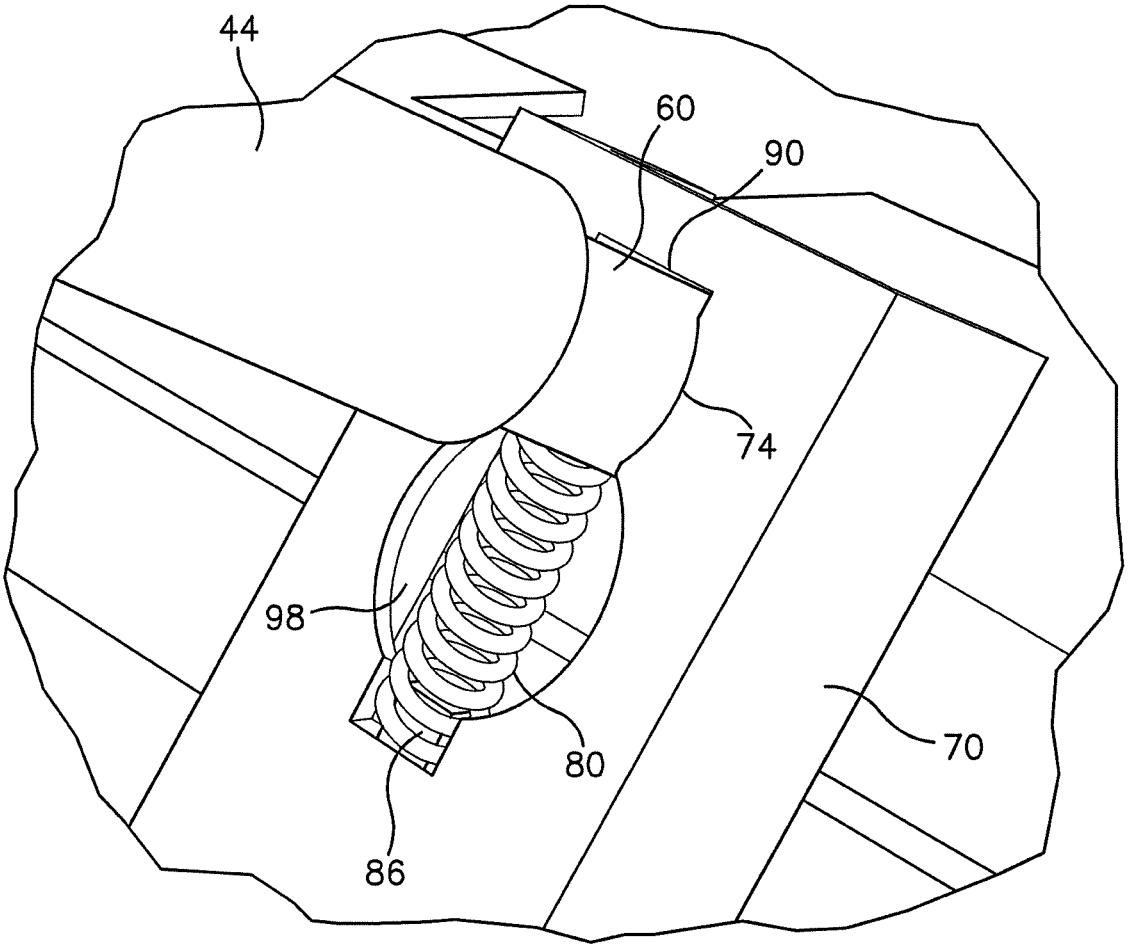
FIG. 5 depicts a view of the press roller engaged within the bracket opening and held in position by a biasing spring configured for a quick change.

A significant advantage of the disclosed system is the ability of the pressure roller 44 to be quickly and easily removed from the mounting brackets 70, 72. As shown in FIG. 5, the first end 60 of the press roller 44 are held in position in the bracket opening 74 by compression spring 80 that is mounted upon a stabilizing post 86. The compression spring 80 biases the roller end 60 against a hard stop 90. In order to remove the first end 60 of the press roller 44 from the bracket 70 a manual force is applied to the press roller 44 compressing the spring 80 and repositioning the first end 60 into a larger area 98 of the bracket opening 74 thereby facilitating lateral movement of the press roller 44 and extraction of the roller end 60 from the bracket 70. The same procedure is employed to remove the second end 62 of the press roller 44 from the second bracket 72. In order to reinstall the same, or a different, press roller the installation process is simply reversed.

In an alternative embodiment, the stabilizing post 86 may be threaded into the bracket 70 thereby allowing the spring 80 to be adjustably compressed against the ends of the press roller 44 and in turn increasing the stiffness of the spring 80. An increased stiffness may be desired for holding workpieces that, for example, have a tendency push up against the press roller 44 with greater force. The threaded stabilizing post 86 can then be rotated to fine tune the spring to respond with a greater or lesser force as needed.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings. Moreover, the order of the components detailed in the system may be modified without limiting the scope of the disclosure.

We claim:

1. A system for reducing the formation of planer snipe on a workpiece passing through a woodworking machine, the system comprising;

a work area of the woodworking machine, the work area further comprising at least one infeed roller, at least one outfeed roller, at least one lower cutter head and at least one upper cutter head wherein the at least one lower cutter head is configured to plane the lower surface of the workpiece and the at least one upper cutter head is configured to plane the upper surface of the workpiece and the at least one infeed roller and the at least one outfeed roller are separably disposed above and opposite from the lower cutter head;

a hood with an interior and an exterior surface for enclosing the work area, the hood secured to one side of the woodworking machine, the hood rotatably operable between a fully open and a fully closed position;

at least one press roller with longitudinally opposed first and second ends, the at least one press roller detachably mounted to first and second brackets secured to the interior surface of the hood, the first and second brackets each comprising a first end and a second end, the first end of each secured to the interior surface of the hood and openings in the first and second brackets are disposed proximate the second ends, the first and second longitudinally opposed ends of the press roller are secured in first and second quick release assemblies within the openings in the second ends of the first and second brackets, the first and second quick release assemblies each comprising a first end of a compression spring mounted on a stabilizing post and a second end of the compression spring biasing a single end of the press roller against a hard stop member of each quick release assembly, wherein in operation the press roller maintains contact with the workpiece transiting through the work area when the hood is in the closed position and the press roller maintains a force applied to the workpiece preventing upward movement of a leading and a trailing portion of the workpiece and the formation of planer snipe on the workpiece.

2. An apparatus for reducing the formation of planer snipe on a workpiece passing through a planer, the apparatus comprising;

a cutting area of the planer, the cutting area further comprising at least one infeed roller, at least one outfeed roller, at least one lower cutter head and at least one upper cutter head wherein the at least one lower cutter head is configured to plane the lower surface of the workpiece and the at least one upper cutter head is configured to plane the upper surface of the workpiece and the at least one infeed roller and the at least one outfeed roller are separably disposed above and opposite from the lower cutter head;

a hood with an interior and an exterior surface for enclosing the cutting area, the hood secured to one side of the planer, the hood rotatably operable between a fully open and a fully closed position;

at least one press roller with longitudinally opposed first and second ends, the at least one press roller detachably mounted to first and second brackets secured to the interior surface of the hood, the first and second brackets each comprise a first end and a second end, the first end mounted to the interior surface of the hood and openings in the first and second brackets are disposed proximate the second ends, the first and second longitudinally opposed ends of the press roller are secured respectively in first and second quick release assemblies within the openings in the second ends of the first and second brackets, the first and second quick release assemblies each further comprising a first end of a compression spring mounted on a stabilizing post and a second end of the compression spring biasing the first end of each press roller against a hard stop member of each quick release assembly, wherein in operation the press roller maintains contact with the workpiece transiting through the cutting area when the hood is in the closed position and the workpiece transits past the infeed roller the at least one press roller maintains a force applied to the workpiece preventing upward movement of a leading and a trailing portion of the workpiece as well as the formation of planer snipe on the workpiece.

3. The apparatus of claim 1, wherein the first and second stabilizing posts include a threaded base.

4. The apparatus of claim 1, wherein the first and second brackets include threads compatible with the threaded base of the stabilizing posts.

5. The apparatus of claim 1, wherein a spring compression force is adjustable by rotating the threaded base of the stabilizing posts.

6. A quick release, snipe limiting, press roller kit for mounting to a rotationally mounted hood of a wood planer with a bottom cutter head, the rotationally mounted hood having an interior surface, the kit comprising;

a press roller with a first end and a second end;

first and second brackets each with a first end and a second end, the second ends mounted to the interior surface of the hood, the second end of the brackets further comprising an opening for insertion of respectively the first and second ends of the press roller and a drop-down channel for securing the ends of the press roller in position; and first and second biasing springs mounted within the bracket openings for biasing the press roller into the drop-down channels, wherein the bracket second ends are mounted to the interior surface of the hood to position the press roller substantially over and parallel to the bottom cutter head in order to maintain pressure against a workpiece traversing through the wood planer and prevent the formation of snipe.

* * * * *